US005715974A

United States Patent [19]

Foster et al.

[11] Patent Number: 5,715,974

[45] Date of Patent: Feb. 10, 1998

[54] TRIGGER SPRAYER HAVING CENTRAL VENT CYLINDER

[75] Inventors: Donald D. Foster, St. Charles; Philip L. Nelson, Ellisville, both of Mo.

[73] Assignee: Contico International, Inc., St. Louis, Mo.

[21] Appl. No.: 727,794

[22] Filed: Oct. 7, 1996

[51] Int. Cl.[6] ..... B67D 5/42

[52] U.S. Cl. ..... 222/383.1

[58] Field of Search ..... 222/383.1, 340, 222/341; 239/333

[56] References Cited

U.S. PATENT DOCUMENTS

| | | | |
|---|---|---|---|
| 3,514,017 | 5/1970 | Malone . | |
| 3,669,316 | 6/1972 | Corsette | 222/397 X |
| 3,897,006 | 7/1975 | Tada | 239/333 |
| 4,153,203 | 5/1979 | Tada | 222/383.1 X |
| 4,189,064 | 2/1980 | O'Neill et al. . | |
| 4,747,523 | 5/1988 | Dobbs | 222/383.1 |
| 4,944,431 | 7/1990 | Blake | 222/383.1 X |
| 5,337,928 | 8/1994 | Foster et al. | 222/383.1 |
| 5,344,053 | 9/1994 | Foster et al. | 222/383.1 X |
| 5,385,302 | 1/1995 | Foster et al. | 222/383.1 X |
| 5,425,482 | 6/1995 | Foster et al. | 222/383.1 X |
| 5,551,636 | 9/1996 | Foster et al. | 222/383.1 X |
| 5,609,299 | 3/1997 | Foster et al. | 222/383.1 X |
| 5,628,434 | 5/1997 | Foster et al. | 222/383.1 |
| 5,636,768 | 6/1997 | Yamada | 222/383.1 |

*Primary Examiner*—Kevin P. Shaver
*Attorney, Agent, or Firm*—Howell & Haferkamp, L.C.

[57] ABSTRACT

A liquid dispenser comprising a dispenser body having a pump mechanism defining a variable volume fluid receiving cavity. A cylindric formation, smaller than the fluid receiving cavity, is within the cavity and a vent passageway is in fluid communication with the cylindric formation. A plunger is reciprocally moveable within the cylindric formation and is configured for moving with the pump mechanism as the pump mechanism is moved between extended and contracted positions. The plunger and cylindric formation are configured such that the vent passageway is in fluid communication with the fluid receiving cavity of the pump mechanism when the pump mechanism is in its contracted position and is configured to block fluid communication between the vent passageway and the fluid receiving cavity when the pump mechanism is in its extended position.

12 Claims, 2 Drawing Sheets

TRIGGER SPRAYER HAVING CENTRAL VENT CYLINDER

BACKGROUND OF THE INVENTION

This invention relates to a liquid dispenser and more particularly to a pump-type pressure buildup trigger sprayer.

A pressure buildup sprayer is a general type of sprayer in which liquid dispensed from the sprayer is raised to a certain pressure level before it is dispensed from the sprayer. Typically, such a sprayer has a manually operated pump which draws liquid from a source of liquid (e.g., a container) and dispenses it through a nozzle via a liquid flow path. A pressure regulating valve within the liquid flow path and downstream of the pump prevents the flow of liquid to the nozzle until the liquid is raised to at least a minimum fluid pressure level. When the fluid pressure reaches the minimum level, the pressure regulating valve opens to permit liquid to be dispensed through the pressure regulating valve and out the nozzle.

To atomize relatively viscous fluids (e.g., cooking oils), it is necessary that the minimum pressure level be sufficiently high. Depending upon the viscosity of the liquid being dispensed and the pattern of spray or stream desired, this minimum pressure will vary. If the pressure is not sufficiently high, then the dispensed liquid will not be atomized, i.e., it will not be dispensed as a spray.

In prior art pressure buildup sprayers, it is often difficult to prime the pump of the sprayer (i.e., displace air in the pump chamber with liquid from the source of liquid). Because of the compressibility of the air in the pump chamber, actuation of the pump does not sufficiently increase the pressure of the air to overcome the biasing force of the pressure regulating valve and open the valve. If the air is not removed from the pump chamber, the sprayer cannot operate.

SUMMARY OF THE INVENTION

Among the several objects of the present invention may be noted the provision of an improved pump-type dispenser; the provision of such a dispenser which vents air from the pump chamber remote from the pressure regulating valve of the dispenser; the provision of such a dispenser capable of atomizing relatively viscous fluids; and the provision of such a dispenser which is of relatively simple construction.

In general, a liquid dispenser of the present invention comprises a dispenser body having a pump mechanism defining a variable volume fluid receiving cavity. The pump mechanism is moveable between a first position in which the fluid receiving cavity has a first volume $V_1$ and a second position in which the fluid receiving cavity has a second volume $V_2$ smaller than the first volume $V_1$. The dispenser body further includes an intake port, a discharge port, an intake liquid flow path, and a discharge liquid flow path. The intake port is adapted for fluid communication with a source of liquid (e.g., liquid contained in a bottle attached to the dispenser). The intake liquid flow path provides fluid communication between the intake port and the fluid receiving cavity of the pump mechanism. The first check valve is in the intake liquid flow path and is configured for permitting fluid flow from the intake port to the fluid receiving cavity of the pump mechanism and for checking fluid flow from the pump mechanism to the intake port. The discharge liquid flow path provides fluid communication between the fluid receiving cavity of the pump mechanism and the discharge conduit. The second check valve is in the discharge liquid flow path and is configured for permitting fluid flow from the fluid receiving cavity of the pump mechanism to the discharge port and for checking fluid flow from the discharge port to the fluid receiving cavity. A cylindric formation is within the fluid receiving cavity of the pump mechanism. A vent passageway defined at least in part by the dispenser body is in fluid communication with the cylindric formation. The plunger is reciprocally moveable within the cylindric formation and is configured for moving with the pump mechanism as the pump mechanism is moved between its first and second positions. The plunger and cylindric formation are configured such that the vent passageway is in fluid communication with the fluid receiving cavity of the pump mechanism when the pump mechanism is in its second position and is configured to block fluid communication between the vent passageway and the fluid receiving cavity when the pump mechanism is in its first position. The dispenser is configured so that movement of the pump mechanism from its first position to its second position when air is in the fluid receiving cavity increases pressure within the fluid receiving cavity to force the air through the vent passageway and thereby prime the pump mechanism. It is also configured so that movement of the pump mechanism from its second position to its first position after air has been evacuated from the fluid receiving cavity creates a vacuum pressure in the fluid receiving cavity to draw liquid from the source of liquid through the first check valve and into the fluid receiving cavity, and is configured so that movement of the pump piston from its first position toward its second position when the fluid receiving cavity is filled with liquid forces the liquid through the second check valve and through the discharge port.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
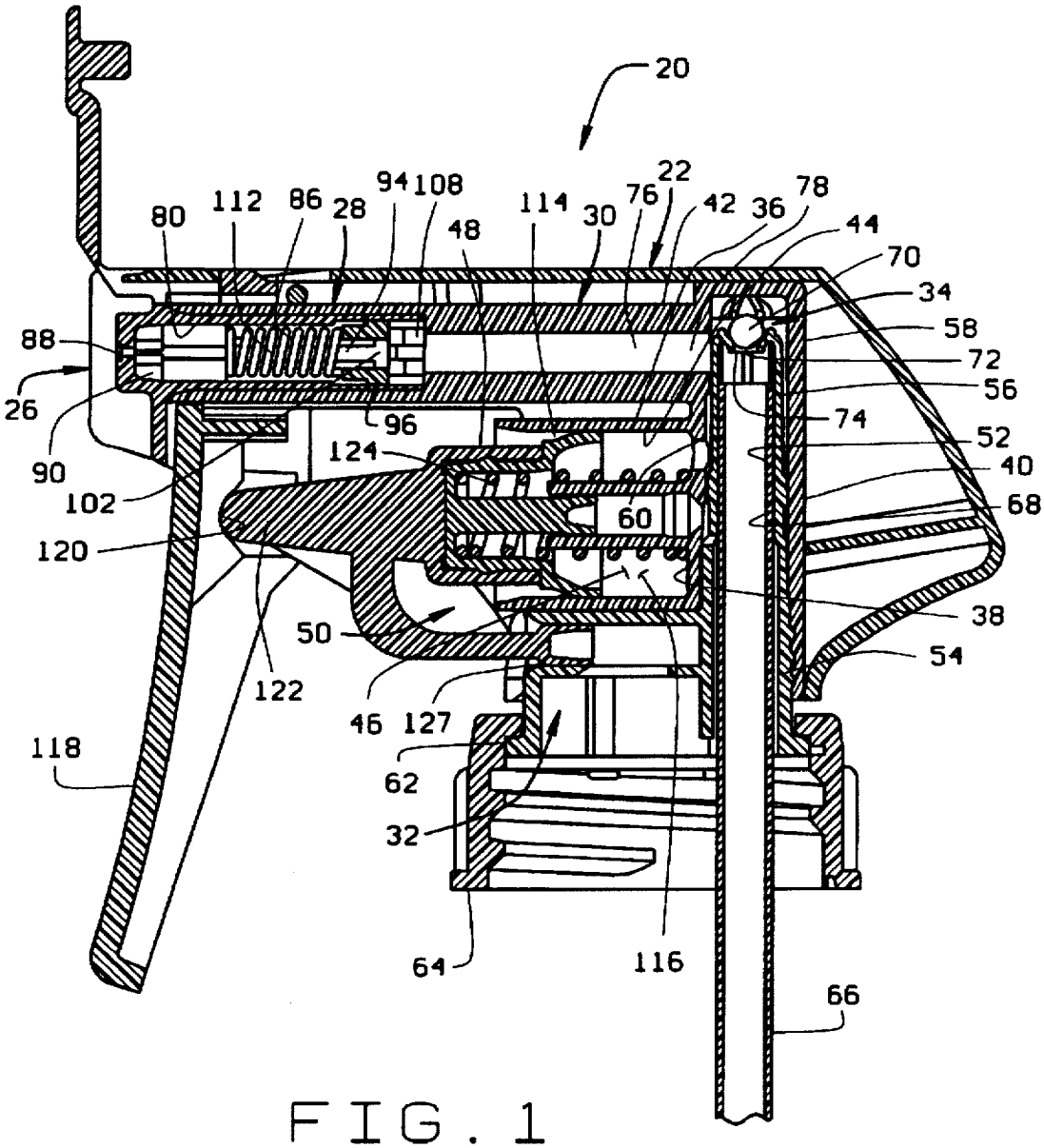
FIG. 1 is a side elevational view, in section, of a liquid dispenser of the present invention.

Referring now to the drawings, and first more particularly to FIG. 1, a spray-type dispenser of the present invention is indicated in its entirety by the reference numeral 20. The dispenser 20 includes a dispenser body, generally indicated at 22, having a valve housing 26 with a pressure buildup valve 28 therein, an upper housing member, generally indicated at 30, a lower housing member, generally indicated at 32, and a ball-type check valve, generally indicated at 34. Preferably, the valve housing 26 and upper and lower housing members 30, 32 are of a polymeric material. However, it is to be understood that some or all of the components may be of other materials without departing from the scope of this invention.

The upper housing member 30 of the dispenser body 22 includes a cylindric wall 36, a disc-shaped back wall 38 substantially closing one end (i.e., the right end as viewed in FIG. 1) of the cylindric wall, a generally cylindric vertical formation 40 adjacent the disc-shaped back wall, and a horizontal tubular portion 42 extending forward from the vertical formation. The cylindric wall 36 includes a generally cylindric inner surface 44. The inner surface 44 of the cylindric wall 36 and the disc-shaped back wall 38 define a pump chamber 46 open at one end (i.e., its left end as viewed in FIG. 1) for slidably receiving a pump piston 48. The pump chamber 46 and pump piston 48 constitute a pump mechanism 50 of the dispenser body 22. Although the pump mechanism 50 preferably includes a pump piston and pump chamber, it is to be understood that other types of pumps (e.g. a resilient bulb-type pump) may be employed without departing from the scope of this invention.

The vertical formation 40 of the upper housing member 30 has a vertical bore 52 extending upward from the bottom of the vertical formation 40. A lower end of the vertical bore 52 receives the lower housing member 32 of the dispenser body 22. More particularly, the lower housing member 32 has a generally cylindric column 54 extending upward into the vertical bore 52 in sealing engagement with the vertical formation 40. Preferably, an upper end portion 56 of the cylindric column 54 is of reduced diameter to define a cylindric gap 58 between the cylindric column and the surface of the vertical bore 52. The cylindric gap 58 is in fluid communication with the pump chamber 46 via a lateral opening 60 through the disc-shaped back wall 38 of the upper housing member 30. The lower housing member 32 also has an annular flange 62.

Preferably a threaded collar 64 (or cap) is retained on the lower housing member 32 via the annular flange 62 for receiving a threaded neck of a liquid bottle (not shown). A dip tube 66 is sealingly press fit into a cylindric inner surface 68 of the cylindric column 54 and depends therefrom. The dip tube 66 is adapted to extend downward into liquid (not shown) within the bottle. The dip tube 66 constitutes a conduit for transporting liquid from the bottle upward into the dispenser body 22. Although the dispenser 20 preferably has a generally straight dip tube extending down into a bottle, it is to be understood that a long flexible tube could alternatively extend from the lower housing member 32 to a source of liquid remote from the sprayer. The check valve 34 comprises a ball 70, an annular valve seat 72 formed at the upper end of the cylindric column 54, and an opening 74 defined by the valve seat. The ball 70 of the check valve 34 is moveable between an open position (shown in phantom in FIG. 1) and a closed position (shown in solid in FIG. 1). In its open position, the ball 70 is spaced above the valve seat 72 to permit liquid to flow upward through the dip tube 66 and around the ball, and then downward into the pump chamber 46 via the cylindric gap 58 and lateral opening 60. The cylindric gap 58 and lateral opening 60 constitute an intake liquid flow path and the opening 74 constitutes an intake port (also indicated at 74) for the intake liquid flow path. In its closed position, the ball 70 seals against the valve seat 72 to plug the intake port 74 and thereby check fluid flow from the pump chamber 46 to the intake port 74.

The horizontal tubular portion 42 of the upper housing member 30 includes a horizontal discharge conduit 76 extending axially therethrough and in fluid communication with the cylindric gap 58. As described in greater detail below, liquid is pumped by the pump piston 48 out of the pump chamber 46 and through the discharge conduit 76 (from right to left as viewed in FIG. 1) via the lateral opening 60 and cylindric gap 58. The lateral opening 60 and cylindric gap 58 constitute part of a discharge liquid flow path and provide fluid communication between the pump mechanism 50 and discharge conduit 76. The discharge conduit 76 includes an upstream portion 78 and a downstream portion (or end) 80 which is downstream of (i.e., forward of) the upstream portion. Preferably, the diameter of the downstream portion 80 is larger than that of the upstream portion 78 for receiving the valve housing 26.

The valve housing 26 and pressure buildup valve are described in detail in co-pending U.S. patent application Ser. No. 08/575,722, filed Dec. 18, 1995 and incorporated herein by reference. The valve housing 26 is sized and configured for a snug friction fit within the downstream portion 80 of the discharge conduit 76 and includes a fluid passageway 86 therein a discharge port (nozzle orifice) 88 in its forward end and in fluid communication with the fluid passageway. Liquid flowing forward through the discharge conduit 76 flows through the fluid passageway 86 and is dispensed through the discharge port 88. Thus, the discharge conduit 76 and fluid passageway 86 also constitute part of the discharge liquid flow path.

The valve housing 26 houses a spinner member 90 and the pressure buildup valve 28. The spinner member 90 is configured to impart a swirl to liquid flowing forward through the fluid passageway 86 to dispense the liquid from the discharge port 88 in a spray pattern. The pressure buildup valve 28 comprises a shaft 94 extending rearwardly from the spinner member 90 and a generally annular valve member 96 slidably mounted on the shaft. Preferably, the shaft 94 is X-shaped in vertical cross section. A disc-shaped valve seat 102 is at the rearward end of the shaft 94. Preferably, a stop 108 is press fit into the rear end of the valve housing for preventing axial movement of the shaft 94 and the spinner member 90 relative to the valve housing 26 and for limiting rearward movement of the annular valve member 96. The stop 108 is generally X-shaped in vertical cross-section to allow fluid to flow between the stop and valve housing. The annular valve member 96 is moveable between a rearward closed (seated) position and a forward open (unseated) position.

The pressure buildup valve 28 also includes a biasing spring 112 for urging the valve member 96 to its closed position. The biasing spring 112 is preferably a compressed coil spring surrounding the shaft 94 and extending between the spinner member 90 and a forward end of the valve member 96. However, it is to be understood that other types of resilient members and/or arrangements could be employed without departing from the scope of this invention.

The pump piston 48 has a piston head 114 preferably formed of a suitable resilient material such as low density polyethylene. The piston head 114 comprises the rearward end (the right most end as viewed in FIG. 1) of the pump piston 48. The piston head 114 is slidable within the pump chamber 46 and configured for sealing engagement with the cylindric inner surface 44 of the pump chamber 46 all around the piston head 114 to seal against leakage of fluid between the pump piston 48 and cylindric inner surface 44. The piston head 114 and pump chamber 46 define a variable volume fluid receiving cavity 116. The pump piston 48 is reciprocally slidable in the pump chamber 46 between a first (extended) position and a second (compressed) position. When the pump piston 48 is in its extended position (shown in FIGS. 1 and 2), the fluid receiving cavity 116 has a first (extended) volume. When the pump piston 48 is in its compressed position (FIG. 3), the fluid receiving cavity 116 has a second (compressed) volume which is smaller than the extended volume.

Preferably, the pump piston 48 is moved from its extended position to its compressed position by a trigger 118. The trigger 118 is connected at its upper end (not shown) to the upper housing member 30 for pivotal movement relative to the upper housing member (i.e., clockwise and counterclockwise movement as viewed in FIG. 1). The trigger 118 has a camming surface 120 engageable with a forward end 122 (i.e., the left most end as viewed in FIG. 1) of the pump piston 48. Counterclockwise movement of the trigger 118 causes the camming surface 120 to push against the pump piston 48 and thereby move the pump piston rearwardly (i.e., from left to right as viewed in FIG. 1). A helical piston spring 124 is positioned between the disc-shaped back wall 38 of the pump chamber 46 and the pump piston 48 for urging the pump piston forward to its extended position. Thus, the pump piston 48 is rearwardly moved from its extended position to its compressed position by manually squeezing the trigger 118, and is automatically returned to its extended position via the piston spring 124 when the operator releases the trigger. After the pump has been primed, i.e., after air has been vented from the fluid receiving cavity 116, forward movement of the pump piston 48 along its axis X creates vacuum pressure (i.e., negative pressure) in the fluid receiving cavity 116. This vacuum pressure causes liquid to be drawn from the bottle into the fluid receiving cavity 116 via the dip tube 66, intake port 74, and intake liquid flow path. Rearward movement of the pump piston 48 increases the pressure in the fluid receiving cavity 116. This increase in fluid pressure closes the check valve 34, opens the pressure buildup valve 28, and forces liquid out the discharge port 88 via the discharge liquid flow path.

Preferably, a bottle vent opening 126 is in the lower housing member 32 for opening the top of the bottle to atmosphere. A plug 127 (FIG. 1) is integrally connected to the pump piston 48 and moveable therewith. The plug 127 is adapted for closing the bottle vent opening 126 when the dispenser 20 is not in use to prevent liquid from spilling out of the bottle via the opening.

To dispense viscous liquids (e.g., cooking oils having a viscosity of 20–30 cps) in a spray pattern, it is necessary that the liquid in the discharge liquid flow path be pressurized to at least a minimum fluid pressure level P. This minimum pressure level will vary depending on the viscosity of the liquid and the discharge pattern of spray or stream desired. If the liquid is not so pressurized, the liquid will exit the discharge port 88 only as a thin stream, if it is discharged at all. Because of this, the biasing spring 112 of the pressure buildup valve 28 preferably has a spring constant sufficient to maintain the valve member 96 of the pressure buildup valve in its closed position when fluid pressure in the fluid receiving cavity 116 is below the minimum fluid pressure level P. This minimum pressure level P is greater than air pressure which could be generated by moving the pump piston 48 from its extended position to its compressed position. In other words, the minimum pressure level P is greater than air pressure which would result from isothermal compression of a given amount of air from the extended volume $V_1$ to the compressed volume $V_2$, assuming that the air is at atmospheric pressure when it is at the first volume $V_1$ and has a temperature of 80° F. Because reciprocation of the pump piston 48 cannot generate sufficient air pressure to open the pressure buildup valve 28, air in the fluid receiving cavity 116 cannot be vented through the discharge liquid flow path and through the discharge port 88.

Figure 2:
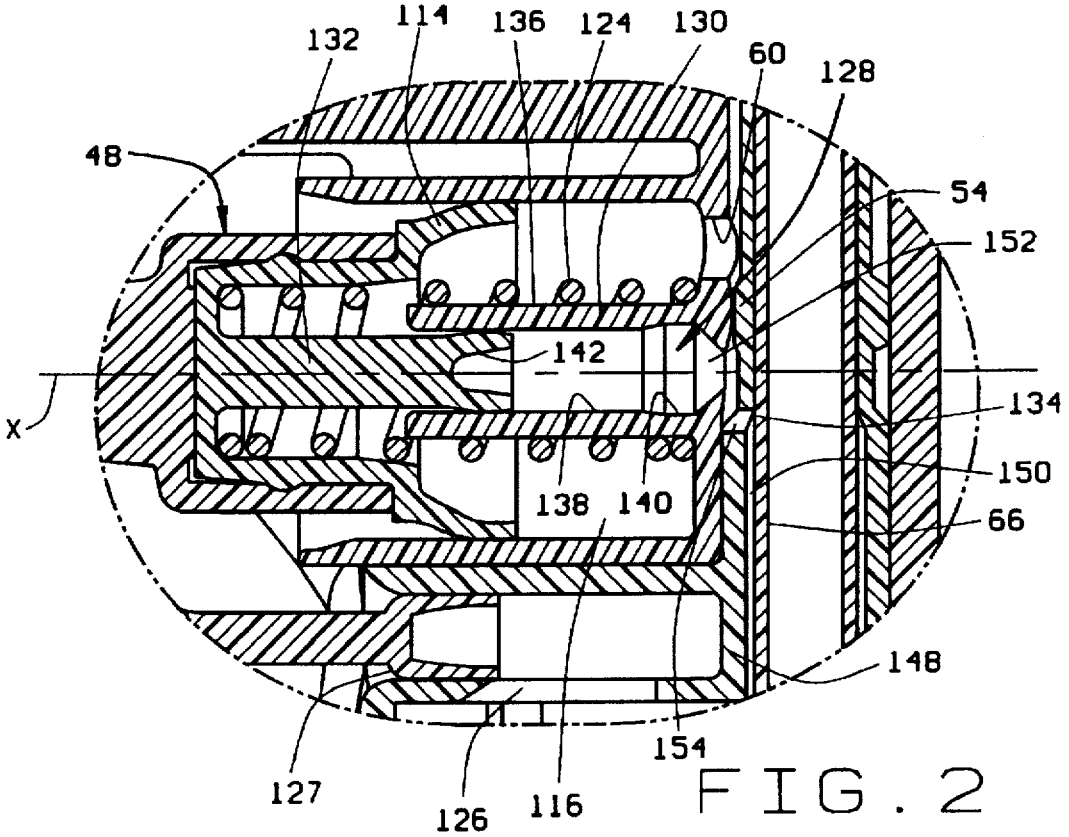
FIG. 2 is an enlarged fragmented view, in section, of a pump mechanism of the liquid dispenser of FIG. 1, showing a pump piston of the mechanism in an extended position relative to a pump chamber of the mechanism.
Figure 3:
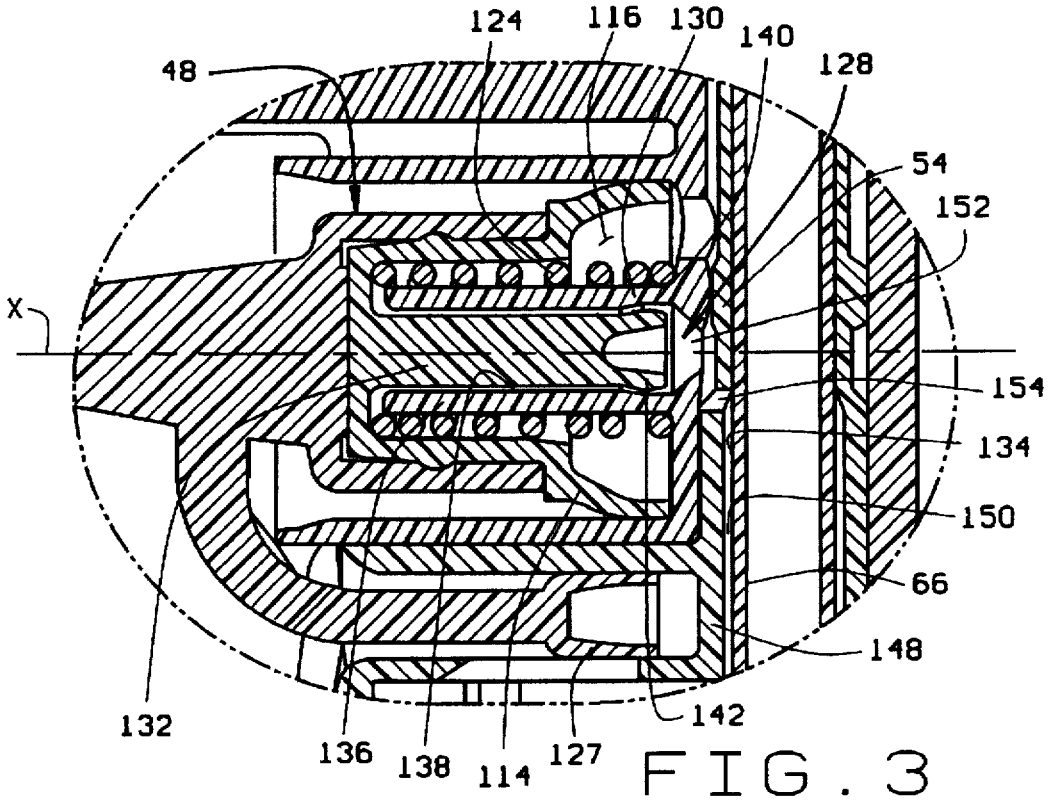
FIG. 3 is an enlarged fragmented view similar to that of FIG. 2 but with the pump piston in a retracted position relative to the pump chamber.

To vent air from the fluid receiving cavity 116 and thereby prime the pump, the dispenser 20 further includes a venting mechanism, generally indicated at 128 in FIGS. 2 and 3. The venting mechanism 128 includes a tubular extension (or cylindric formation) 130 extending forward from the disc-shaped back wall 38 of the upper housing member 30, a plunger 132 extending rearward from and moveable with the piston head 114, and a vent passageway, generally indicated at 134, providing fluid communication between the rearward end of the tubular extension and the interior of the bottle. The tubular extension 132 is surrounded by and coaxial with the cylindric wall 36.

Preferably, the plunger 132 is integrally formed with the piston head 114 and reciprocates within the tubular extension 130 as the piston head 114 reciprocates within the pump chamber 46. The tubular extension 130 has a forward region 136 with a cylindric inner surface 138 of generally constant diameter, and a rearward enlarged region 140. The plunger 132 has a plunger head 142 at its rearward end configured for sealing engagement with the cylindric inner surface 138 of the tubular extension 130 all around the plunger head to seal against leakage of fluid between the tubular extension and plunger head and thereby prevent fluid to flow from the fluid receiving cavity 116 of the pump chamber 46 and the vent passageway 134. The plunger 132 is reciprocally slidable along the axis X and in the tubular extension 130 between a forward position (FIG. 2) and a rearward position (FIG. 3). The plunger head 142 is surrounded by the rearward enlarged region 140 of the tubular extension 130 when the plunger 132 is in its rearward position, and is surrounded by the forward region 136 when the plunger is forward of its rearward position. The enlarged region 140 of the tubular extension 130 preferably has a diameter larger than that of the plunger head 142 or is otherwise shaped so that the plunger head does not seal against the tubular extension when the plunger is in its rearward position. Because the plunger head 142 does not seal against the rearward enlarged region 140 of the tubular extension 130, the vent passageway 134 is in fluid communication with the fluid receiving cavity 116 when the plunger 132 is in its rearward position.

Preferably, the cylindric inner surface 68 of the cylindric column 54 has an enlarged diameter section 148 at its lower region to define a tubular gap 150 between the cylindric column and the dip tube 66. The tubular gap 150 is in fluid communication with the rearward enlarged region 140 of the tubular extension 132 via a lateral opening 152 through the disc-shaped back wall 38 of the upper housing member 30 and an aligned opening 154 through the cylindric column 54. The tubular gap 150 and the lateral opening 152 constitute the vent passageway 134.

In operation, the spray-type dispenser 20 initially will have air in the fluid receiving cavity 116, but no liquid. The air must be vented to enable the dispenser to dispense liquid. The operator squeezes the trigger 118 to move the pump piston 48 rearward to its compressed position (FIG. 3). Movement of the pump piston 48 to its compressed position causes the plunger head 142 to be within the rearward enlarged region 140 of the tubular extension 132 to provide fluid communication between the fluid receiving cavity 116 and the vent passageway 134 to vent the air from the fluid receiving cavity and into the bottle. Because air pressure within the fluid receiving cavity 116 is insufficient to overcome the biasing force of the biasing spring of the pressure buildup valve 28 when the pump piston 48 is moved to its compressed position, the pressure buildup valve remains closed. The operator then releases the trigger 118 and the piston spring 124 moves the pump piston 48 forward to its extended position. This forward movement of the pump piston 48 after air has been evacuated from the fluid receiving cavity 116 creates a vacuum pressure in the fluid receiving cavity which moves the ball 70 of the check valve 34 up away from the valve seat 72 and draws liquid from the bottle into the fluid receiving cavity via the dip tube 66 and intake liquid flow path. When the pump piston 48 reaches its extended position, the liquid in the fluid receiving cavity 116 has a volume of approximately $V_1$. Subsequent rearward movement of the pump piston 48 unseats the valve member 96 of the pressure buildup valve 28 to open the pressure buildup valve and permit pressurized delivery of the liquid through the discharge port 88. Because the liquid is dispensed through the discharge port 88 at a pressure of at least the minimum fluid pressure level P, the liquid will be dispensed in a desired spray pattern.

Because the fluid receiving cavity 116 is in fluid communication with the vent passageway 134 only when the pump piston 48 is in its fully compressed position, almost all of the liquid in the fluid receiving cavity is discharged through the discharge port 88. Only a small amount of the liquid passes through the vent passageway 134 and such amount flows through the vent passageway back into the bottle. Thus, the venting mechanism 128 vents air from the fluid receiving cavity 116 to initially prime the pump, but does not substantially interfere with the discharge of liquid from the fluid receiving cavity.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a liquid dispenser comprising a dispenser body having a pump mechanism defining a variable volume fluid receiving cavity, the pump mechanism being moveable between a first position in which the fluid receiving cavity has a first volume $V_1$ and a second position in which the fluid receiving cavity has a second volume $V_2$ smaller than the first volume $V_1$, the dispenser body further including an intake port adapted for fluid communication with a source of liquid, an intake liquid flow path providing fluid communication between the intake port and the fluid receiving cavity of the pump mechanism, a first check valve in the intake liquid flow path configured for permitting fluid flow from the intake port to the fluid receiving cavity of the pump mechanism and for checking fluid flow from the pump mechanism to the intake port, a discharge port, a discharge liquid flow path providing fluid communication between fluid receiving cavity of the pump mechanism and discharge conduit, and a second check valve in the discharge liquid flow path configured for permitting fluid flow from the fluid receiving cavity of pump mechanism to the discharge port and for checking fluid flow from the discharge port to the fluid receiving cavity, the improvement comprising:

a cylindric formation within the fluid receiving cavity of the pump mechanism;

a vent passageway in fluid communication with the cylindric formation;

a plunger reciprocally moveable within the cylindric formation and configured for moving with the pump mechanism as the pump mechanism is moved between its first and second positions, the plunger and cylindric formation being configured such that the vent passageway is in fluid communication with the fluid receiving cavity of the pump mechanism when the pump mechanism is in its second position and being configured to block fluid communication between the vent passageway and the fluid receiving cavity when the pump mechanism is in its first position;

wherein movement of the pump mechanism from its first position to its second position when air is in the fluid receiving cavity increases pressure within the fluid receiving cavity to force the air through the vent passageway and thereby prime the pump mechanism, movement of the pump mechanism from its second position to its first position after air has been evacuated from the fluid receiving cavity creates a vacuum pressure in the fluid receiving cavity to draw liquid from said source of liquid through the first check valve and into the fluid receiving cavity, and movement of the pump piston from its first position toward its second position when the fluid receiving cavity is filled with liquid forces the liquid through the second check valve and through the discharge port.

2. A liquid dispenser as set forth in claim 1 wherein the cylindric formation has an outer surface and wherein the outer surface of said cylindric formation in part defines the fluid receiving cavity.

3. A liquid dispenser as set forth in claim 1 wherein the pump mechanism comprises a generally cylindric pump chamber and a pump piston having a head at its inner end slidable within the pump chamber configured for sealing engagement with the pump chamber all around the head of the piston to seal against leakage of fluid between the pump chamber and the head of the piston, the head of the piston and pump chamber defining the fluid receiving cavity, the pump piston being reciprocally slidable in the pump chamber between a first position corresponding to the first position of the pump mechanism and a second position corresponding to the second position of the pump mechanism.

4. A liquid dispenser as set forth in claim 3 wherein the cylindric pump chamber surrounds the cylindric formation.

5. A liquid dispenser as set forth in claim 4 wherein the plunger is fixed to and moveable with the pump piston.

6. A liquid dispenser as set forth in claim 5 further comprising a coil spring for urging the pump piston toward its first position, the spring surrounding the cylindric formation and the plunger.

7. A liquid dispenser as set forth in claim 6 further comprising a trigger operatively connected to the pump piston for manually reciprocating the pump piston.

8. A liquid dispenser comprising:

a dispenser body member having a generally cylindric inner surface, a pump chamber defined at least in part by the cylindric inner surface, an intake port adapted for fluid communication with a source of liquid, an intake liquid flow path providing fluid communication between the intake port and pump chamber, a discharge port, and a discharge liquid flow path providing fluid communication between the pump chamber and discharge port;

a first check valve in the intake liquid flow path configured for permitting fluid flow from the intake port to the pump chamber and for checking fluid flow from the pump chamber to the intake port;

a second check valve in the discharge liquid flow path moveable between a closed position for blocking fluid flow between the pump chamber and discharge port and an open position for permitting fluid to flow from the pump chamber through the discharge liquid flow path and out the discharge port;

a pump piston having a head at its inner end slidable within the pump chamber configured for sealing engagement with the cylindric inner surface of the dispenser body all around the head of the piston to seal against leakage of fluid between the cylindric inner surface of the dispenser body and the head of the piston, the head of the piston and pump chamber defining a variable volume fluid receiving cavity, the pump piston being reciprocally slidable in the pump chamber between a first position in which the fluid receiving cavity has a first volume $V_1$ and a second position in which the fluid receiving cavity has a second volume $V_2$ smaller than the first volume $V_1$;

the dispenser body member further including a cylindric formation within the fluid receiving cavity;

a vent passageway defined at least in part by the dispenser body member and in fluid communication with the cylindric formation; and a plunger operatively connected to the pump piston, the plunger being reciprocally moveable within the cylindric formation and configured for moving with the pump piston as the pump piston is moved between its first and second positions, the plunger and cylindric formation being configured such that the vent passageway is in fluid communication with the fluid receiving cavity of the when the pump piston is in its second position and being configured to block fluid communication between the vent passageway and the fluid receiving cavity when the pump piston is in its first position;

wherein movement of the pump piston from its first position to its second position when air is in the fluid receiving cavity increases pressure within the fluid receiving cavity to force the air through the vent passageway, movement of the pump piston from its second position to its first position after air has been evacuated from the fluid receiving cavity creates a vacuum pressure in the fluid receiving cavity to draw liquid from said source of liquid through the first check valve and into the fluid receiving cavity, and movement of the pump piston from its first position toward its second position when the fluid receiving cavity is filled with liquid forces the liquid through the second check valve and through the discharge port.

9. A liquid dispenser as set forth in claim 8 wherein said cylindric inner surface surrounds the cylindric formation.

10. A liquid dispenser as set forth in claim 8 further comprising a coil spring for urging the pump piston toward its first position, the spring surrounding the cylindric formation and the plunger.

11. A liquid dispenser as set forth in claim 8 further comprising a trigger operatively connected to the pump piston for manually reciprocating the pump piston.

12. A liquid dispenser as set forth in claim 8 wherein the cylindric inner surface and the cylindric formation are generally coaxial.

* * * * *